US011016432B2

(12) United States Patent
Makita et al.

(10) Patent No.: US 11,016,432 B2
(45) Date of Patent: May 25, 2021

(54) SENSOR HOLDER AND SENSOR HOUSING UNIT

(71) Applicant: FUJI XEROX CO., LTD., Tokyo (JP)

(72) Inventors: Shota Makita, Kanagawa (JP); Takashi Akaike, Kanagawa (JP); Yosuke Kuwata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/297,726

(22) Filed: Mar. 11, 2019

(65) Prior Publication Data

US 2020/0096934 A1 Mar. 26, 2020

(30) Foreign Application Priority Data

Sep. 25, 2018 (JP) ..... JP2018-178510

(51) Int. Cl.
*G03G 21/16* (2006.01)
*G03G 15/08* (2006.01)

(52) U.S. Cl.
CPC ..... *G03G 21/1647* (2013.01); *G03G 15/0849* (2013.01); *G03G 2215/0888* (2013.01)

(58) Field of Classification Search
CPC ..... G03G 15/0849; G03G 21/1647; G03G 2215/0888
See application file for complete search history.

(56) References Cited

U.S. PATENT DOCUMENTS 8,763,970 B2 * 7/2014 Mordau ..... B60S 1/0822 248/300
9,645,538 B2 * 5/2017 Watanabe ..... G03G 15/556
2018/0038717 A1 * 2/2018 Vidal ..... G01D 11/245

FOREIGN PATENT DOCUMENTS

JP 2017161724 9/2017

* cited by examiner

*Primary Examiner* — Erika J Villaluna
(74) *Attorney, Agent, or Firm* — JCIPRNET

(57) ABSTRACT

A sensor holder includes a holder body that accommodates a sensor, a first snap fit that presses the sensor from a rear surface of the sensor, and two second snap fits that fix the holder body to the housing at at least two points.

16 Claims, 9 Drawing Sheets

SENSOR HOLDER AND SENSOR HOUSING UNIT

CROSS-REFERENCE TO RELATED APPLICATIONS

This application is based on and claims priority under 35 USC 119 from Japanese Patent Application No. 2018-178510 filed Sep. 25, 2018.

BACKGROUND

(i) Technical Field

The present disclosure relates to a sensor holder and a sensor housing unit.

(ii) Related Art

A developing device that contains toner to develop an electrostatic latent image on an image carrier with the toner, and an image forming apparatus that includes such a developing device to form images on a recording medium are known thus far. Some of such developing devices include a sensor that measures the amount or density of toner (the ratio of toner to the carrier) contained in the developing device.

For example, Japanese Unexamined Patent Application Publication No. 2017-161724 describes a sensor holder accommodating a toner sensor, the sensor holder being attached to an image forming unit of an image forming apparatus using snap fits.

SUMMARY

Aspects of non-limiting embodiments of the present disclosure relate to a device capable of easily attaching a sensor to a housing unit with a low cost.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a sensor holder, which includes a holder body that accommodates a sensor, a first snap fit that presses the sensor from the rear of the sensor, and two second snap fits that fix the holder body to a housing at at least two points.

BRIEF DESCRIPTION OF THE DRAWINGS

Exemplary embodiments of the present disclosure will be described in detail based on the following figures, wherein.

DETAILED DESCRIPTION

Exemplary Embodiments

Figure 1:
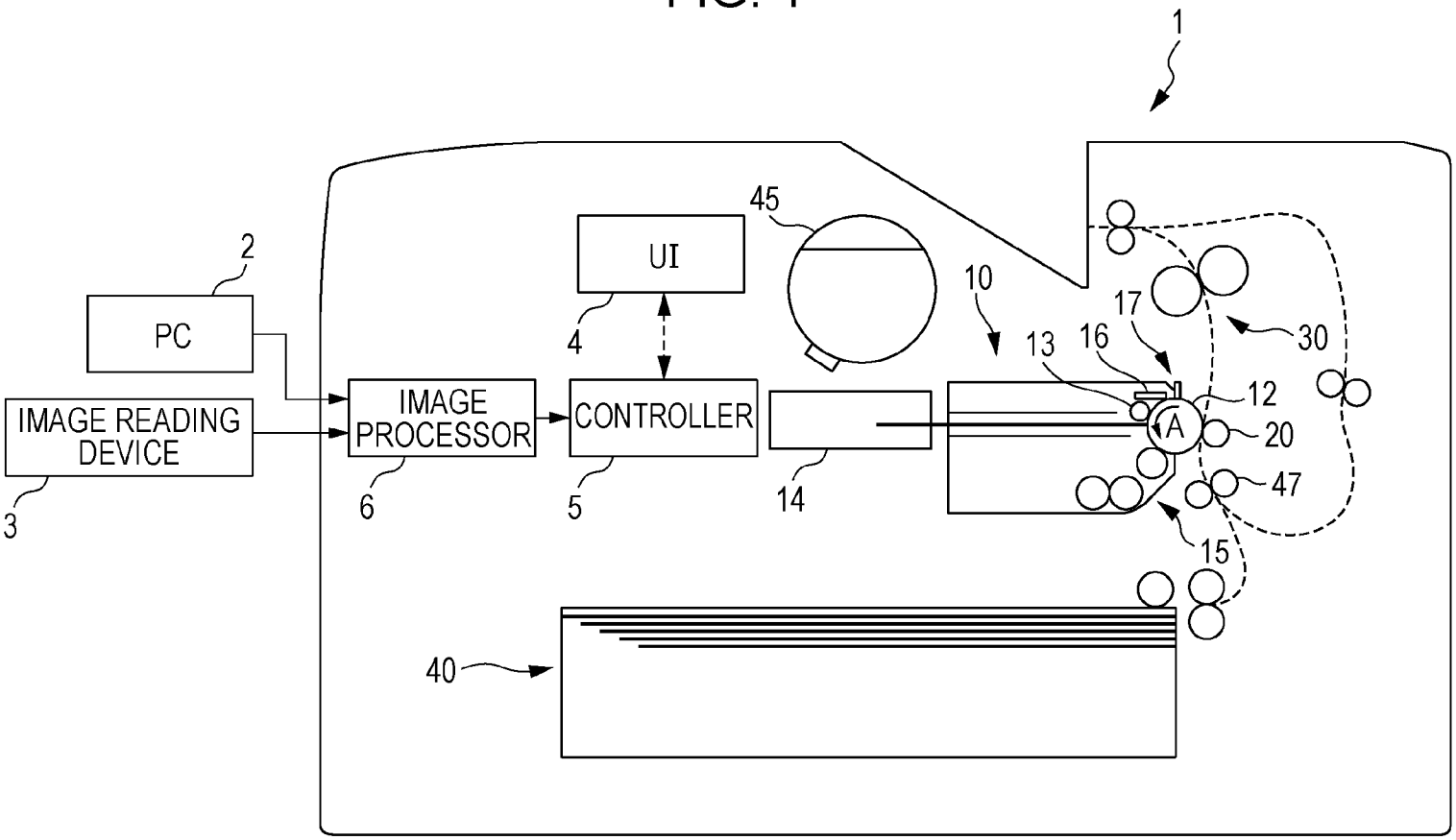
FIG. 1 illustrates a structure of an image forming apparatus according to an exemplary embodiment.

FIG. 1 illustrates a structure of an image forming apparatus 1 according to an exemplary embodiment. The image forming apparatus 1 includes an image forming unit 10, which forms images corresponding to image data, a user interface (UI) 4, which receives instructions from users and displays messages or other information for the users, and a controller 5, which controls operations of the entirety of the image forming apparatus 1. The image forming apparatus 1 also includes an image processor 6, which is connected to external devices such as a personal computer (PC) 2 and an image reading device 3 and performs image processing on image data that it has received from the external devices.

The image forming apparatus 1 also includes a recording-medium feeding portion 40, which feeds recording media to the image forming unit 10, and a toner cartridge 45, which feeds toner to the image forming unit 10.

The image forming unit 10 includes a photoconductor drum 12, a charging device 13, an exposure device 14, a development housing 50 (an example of a housing), and a cleaner 16. The photoconductor drum 12 is a rotatable image carrier, on which an electrostatic latent image is formed, and which carries a toner image. The charging device 13 electrically charges the surface of the photoconductor drum 12. The exposure device 14 irradiates the surface of the photoconductor drum 12 with, for example, a laser beam to expose the photoconductor drum 12 electrically charged by the charging device 13 to light. Specifically, the exposure device 14 selectively exposes the surface of the photoconductor drum 12 negatively charged by the charging device 13 to light to selectively reduce the surface potential of the photoconductor drum 12 and form an electrostatic latent image on the surface of the photoconductor drum 12. The development housing 50 develops an electrostatic latent image formed on the photoconductor drum 12. The cleaner 16 cleans the surface of the photoconductor drum 12 after transfer. The photoconductor drum 12 according to the present exemplary embodiment includes a rotation shaft, not illustrated, and the axial direction of the rotation shaft extends from the front (near side of the drawing) to the rear (far side of the drawing) of the image forming apparatus 1.

The image forming unit 10 also includes a developing device 15, a transfer roller 20, a fixing device 30, a separator member 17, and transport rollers 47. The transfer roller 20 forms a transfer portion between itself and the photoconductor drum 12, at which it transfers a toner image formed on the photoconductor drum 12 to a recording medium. The fixing device 30 fixes the transferred toner image onto the recording medium. The separator member 17 separates, from the surface of the photoconductor drum 12, a recording medium to which a toner image has been transferred by the transfer roller 20. The transport rollers 47 transport a recording medium toward the transfer roller 20.

Figure 2:
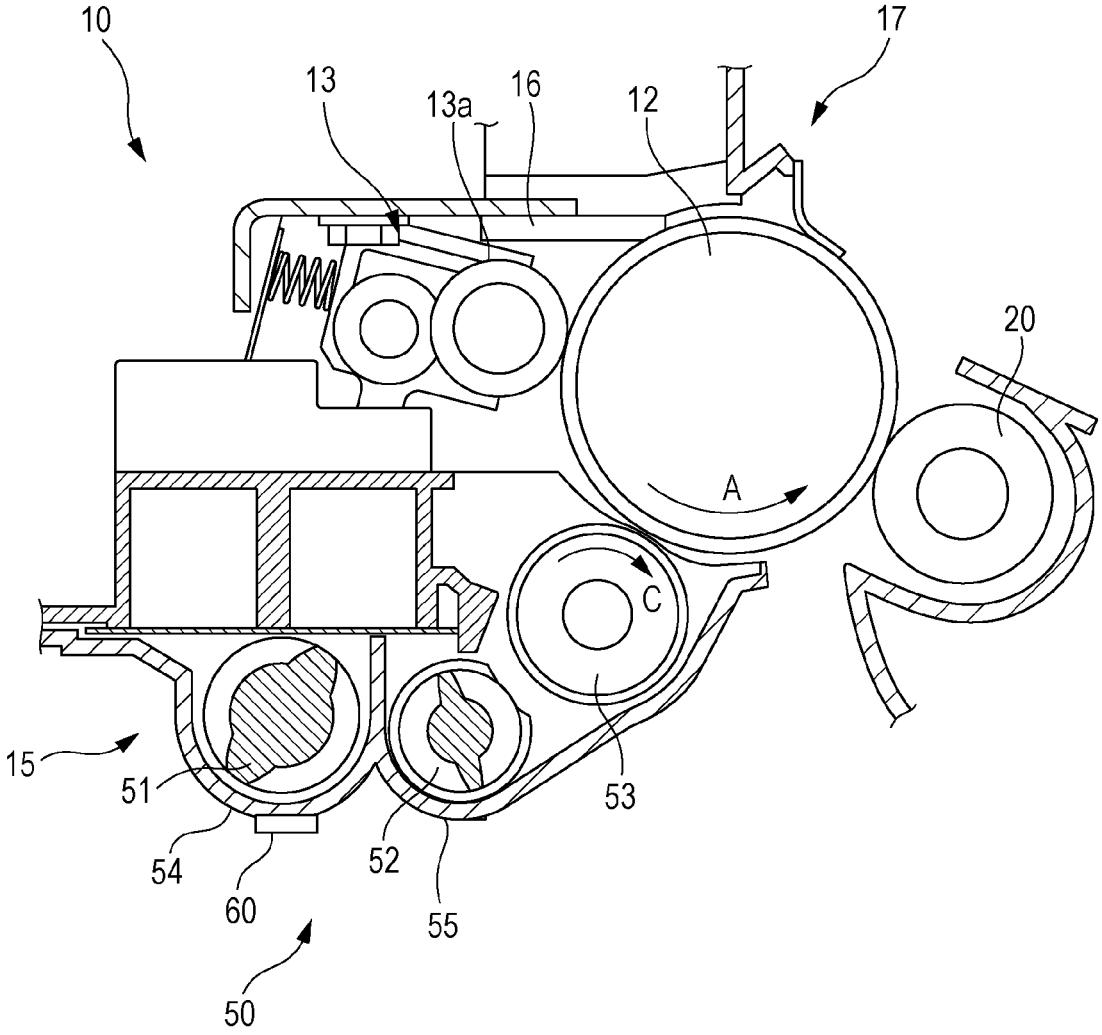
FIG. 2 illustrates a structure of an image forming unit according to an exemplary embodiment.

FIG. 2 illustrates a structure of the image forming unit 10 according to an exemplary embodiment. The development housing 50 contains a developer, and includes a development roller 53, and a first auger 51 and a second auger 52, disposed parallel to the axis of the photoconductor drum 12. The first auger 51 and the second auger 52 transport the developer to the development roller 53. In the present exemplary embodiment, a binary developer containing electrically charged toner and a carrier, which is magnetic particles, is used as an example of the developer.

The development roller 53 is a developing member that holds a developer and develops the electrostatic latent image on the photoconductor drum 12 with a developer. The development roller 53 is disposed facing the photoconductor drum 12 and driven to rotate in the direction of arrow C by a driving member, not illustrated.

The developer contained in the development housing 50 is fed to the development roller 53. The development housing 50 includes a first chamber 54, accommodating the first auger 51, and a second chamber 55, accommodating the second auger 52. The first auger 51 in the first chamber 54 transports the developer while agitating the developer. When the developer reaches the downstream side of the first chamber 54, the developer is discharged to the second chamber 55. The second auger 52 in the second chamber 55 feeds the developer to the development roller 53 while agitating and transporting the developer that it has received from the first chamber 54.

The development roller 53 allows the fed developer to adhere to its surface with a magnetic force, and transports the developer to a portion of the photoconductor drum 12 opposing the development roller 53. Thus, the electrostatic latent image formed on the surface of the photoconductor drum 12 is developed with the toner in the developer to form a toner image on the surface of the photoconductor drum 12.

After development with toner, the developer adhering to the surface of the development roller 53 returns to the second chamber 55, and returns to the first chamber 54 from the downstream side of the second chamber 55. Thus, the developer circulates inside the first chamber 54 and the second chamber 55 with the first auger 51 and the second auger 52.

On the lower surface of the first chamber 54 of the development housing 50, a sensor holder 60, which detects the toner density inside the development housing 50, is disposed. As described above, after repeated development with toner, the amount of toner in the circulating developer decreases. A detection signal output from the sensor holder 60 is input to the controller 5. The controller 5 feeds toner from the toner cartridge 45 to the development housing 50 at predetermined timing in accordance with the toner density inside the development housing 50, detected by the sensor in the sensor holder 60. A toner feed port is disposed at an upstream portion of the first chamber 54 of the development housing 50. Toner is fed from the toner feed port, and transported to the downstream side of the first chamber 54 and agitated by the first auger 51.

Figure 3:
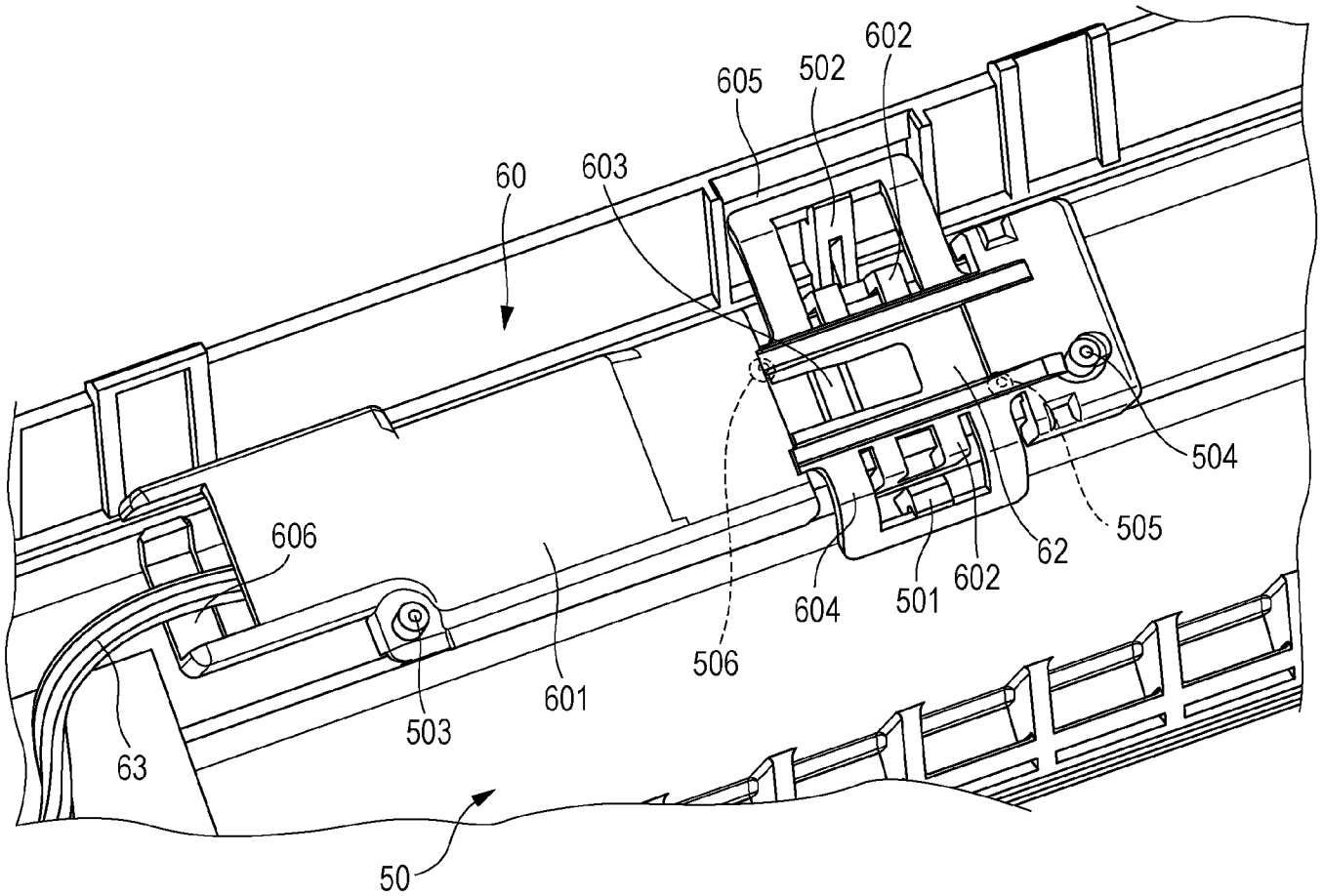
FIG. 3 is a perspective view of a structure of a sensor holder according to an exemplary embodiment.

FIG. 3 is a perspective view of a structure of the sensor holder 60. A combination of the sensor holder 60 and the development housing 50 forms a sensor housing unit. FIG. 3 is a perspective view of the development housing 50, viewed from the bottom. The sensor holder 60 is attached to the lower surface of the development housing 50. The sensor holder 60 includes a holder body 601 and snap fits 602, 603, 604, and 605, and accommodates a sensor 62, having a board shape. The sensor 62 is in contact with the surface of the development housing 50 while the holder body 601 is attached to the development housing 50. A wire harness 63, which is a bundle of wires for power supply or signal input/output, is connected to the sensor 62, and wired to the outside of the holder body 601.

As illustrated in FIG. 3, the sensor holder 60 includes the holder body 601, a pair of snap fits 602 (an example of third snap fits) for holding the sensor 62, and a snap fit 603 (an example of a first snap fit) for pressing the sensor 62 against the surface of the development housing 50. The snap fit 603 is a protrusion having a function of pushing the sensor 62, as described below. In this sense, the snap fit 603 is also referred to as "a push lug". The portion of the snap fit 603 other than a protrusion 603*a* is referred to as a support portion. The support portion has a first end connected to the holder body 601, and a second end, which is closer to the protrusion 603*a*, left unsupported. The support portion extends in the direction corresponding to the longitudinal direction of the sensor 62. The holder body 601 also includes the snap fits 604 and 605 for attaching the holder body 601 to the development housing 50. The snap fits 604 and 605 are examples of a second snap fit for fixing the holder body 601 to the development housing 50 at at least two points. The holder body 601 also includes a guide member 606, which holds a part of the wire harness 63 to guide the wire harness 63 to the outside of the holder body 601.

Figure 4:
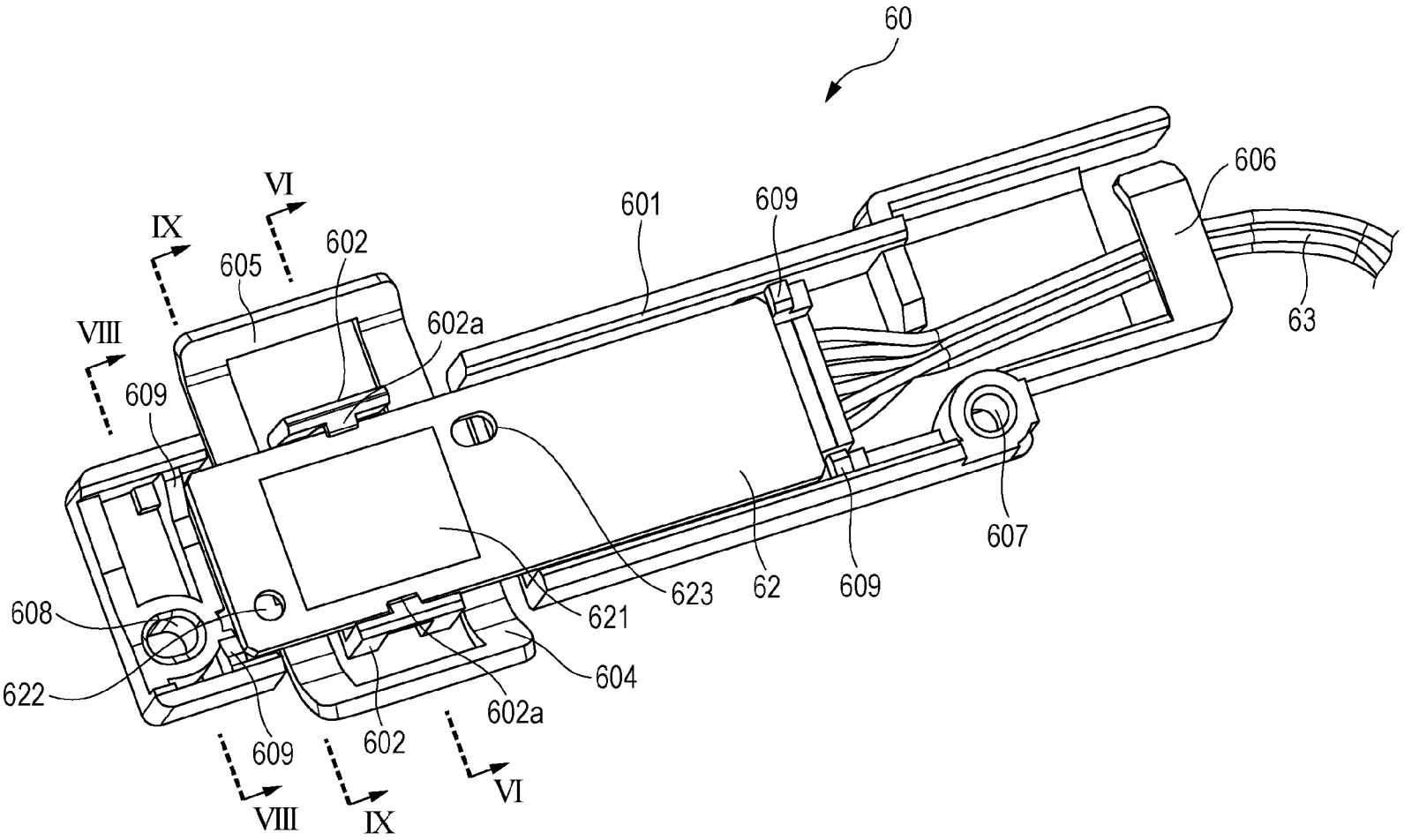
FIG. 4 is a perspective view of a structure of a sensor holder according to an exemplary embodiment.

The development housing 50 includes a protrusion 501 (an example of a first protrusion), engaged with the snap fit 604, and a protrusion 502 (an example of a second protrusion), engaged with the snap fit 605. The protrusions 501 and 502 protrude from the surface of the development housing 50. The development housing 50 also includes bosses 503 and 504 (examples of a first boss), which are used to fix the position of the holder body 601 to the development housing 50 when the holder body 601 is attached. The development housing 50 also includes bosses 505 and 506 (examples of a second boss), which are used to fix the position of the sensor 62 to the development housing 50 when the holder body 601 is attached. In FIG. 4, the bosses 505 and 506 are hidden under the holder body 601. The bosses 503, 504, 505, and 506 protrude from the surface of the development housing 50, and have a cylindrical shape with a conical tip end.

FIG. 4 is a perspective view of a structure of the sensor holder 60, viewed in the direction opposite to the direction in which FIG. 3 is viewed. As illustrated in FIG. 4, the pair of snap fits 602 of the holder body 601 hold the rectangular sensor 62. The pair of snap fits 602 are disposed on both sides of the sensor 62 to hold a portion of the sensor 62 in the longitudinal direction between them to restrict movement of the sensor 62 in the direction perpendicular to the longitudinal direction of the sensor 62. The pair of snap fits 602 each include a lug 602*a* to restrict movement of the sensor 62 to the near side of the drawing, which is perpendicular to the surface of the sensor 62.

The sensor 62 includes a sensor surface 621, which is a toner density sensor. The sensor 62 also includes a circular round hole 622 and an elliptical long hole 623, which is long in the longitudinal direction (first direction) of the sensor 62. The holes 622 and 623 are used to fix the position of the sensor 62 to the development housing 50 when the sensor holder 60 is to be attached to the development housing 50. When the sensor holder 60 is to be attached to the development housing 50, the boss 505 of the development housing 50 is fitted into the round hole 622 of the sensor 62, and the boss 506 of the development housing 50 is fitted into the long hole 623 of the sensor 62.

The holder body 601 includes a circular round hole 607 (an example of a second hole) and an elliptical long hole 608 (an example of a first hole), which is long in the longitudinal direction of the sensor 62. The holes 607 and 608 are used to fix the position of the holder body 601 to the development housing 50 when the sensor holder 60 is attached to the development housing 50. When the sensor holder 60 is attached to the development housing 50, the boss 503 of the development housing 50 is fitted into the round hole 607 of the sensor 62, and the boss 504 of the development housing 50 is fitted into the long hole 608 of the sensor 62. The round hole 607 is located further from the snap fits 604 and 605 than the long hole 608. The round hole 607 is deeper than the long hole 608. Thus, when the sensor holder 60 is attached to the development housing 50, a portion of the sensor holder 60 (portion closer to the guide member 606) further than the portion of the sensor holder 60 fixed with the snap fits 604 and 605 is stably fixed to the development housing 50.

The holder body 601 includes ribs 609, which are four protrusions, around the position at which the sensor 62 is attached. The four ribs 609 include two ribs disposed at a first side of the sensor 62 in the longitudinal direction, and two ribs disposed at a second side of the sensor 62 in the longitudinal direction. The ribs 609 are arranged so that when the sensor 62 moves in the longitudinal direction, the short side of the sensor 62 comes into contact with the ribs 609 on the side to which the sensor 62 has moved. The ribs 609 thus arranged restrict movement of the sensor 62 in the longitudinal direction. The distance between the ribs 609 are adjusted to allow the sensor 62 to move in the longitudinal direction to some extent for fixing the position of the sensor 62 when the sensor holder 60 is attached to the development housing 50. Specifically, the ribs 609 restrict movement of the sensor 62 in the longitudinal direction, while allowing the sensor 62 to move within the range until the sensor 62 comes into contact with the ribs 609.

The guide member 606 is disposed at an end of the holder body 601 in the longitudinal direction, which is further when viewed from the snap fits 602, 603, 604, and 605. The position of the guide member 606 in the height direction (vertical direction in FIG. 4) is preferably lower than the sensor 62 (on the further side in FIG. 4). Such a structure keeps the wire harness 63 pressed downward by the guide member 606 (to the further side in FIG. 4). This structure thus prevents the portion of the sensor 62 further from the snap fits 602 and 603 from rising upward (to the near side in FIG. 4).

Figure 5:
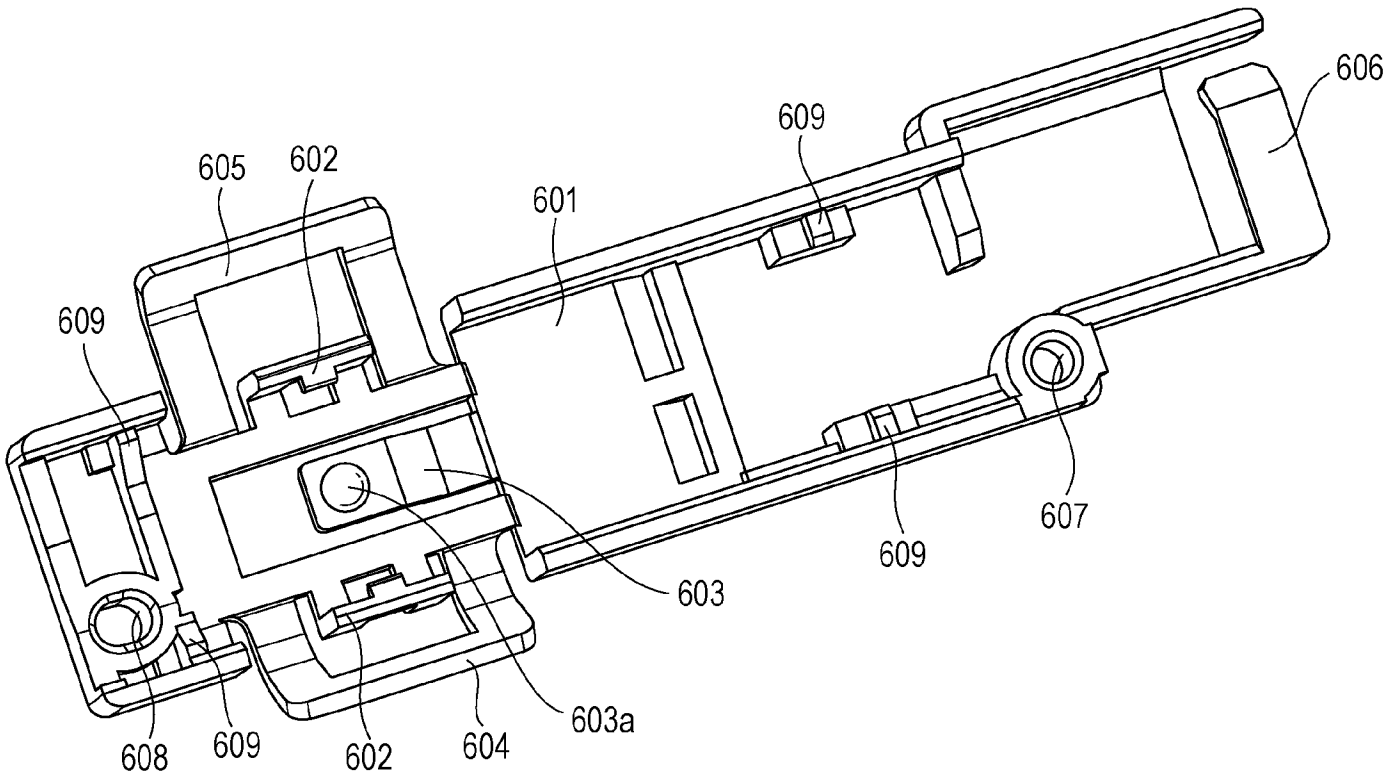
FIG. 5 is a perspective view of a structure of a sensor holder according to an exemplary embodiment.

FIG. 5 is a perspective view of a structure of the holder body 601, in the state where the sensor 62 and the wire harness 63 illustrated in FIG. 4 are removed. The snap fit 603 extends in the longitudinal direction of the holder body 601 in an opening of the holder body 601. The snap fit 603 includes the protrusion 603*a*, which protrudes to the side from which the sensor 62 is attached, at a portion near the tip end. The protrusion 603*a* has a round shape. In the state where the sensor 62 is attached to the holder body 601 while having its movement restricted by the snap fits 602, the protrusion 603*a* of the snap fit 603 comes into contact with the sensor 62 to press the sensor 62. The protrusion 603*a* of the snap fit 603 presses the portion of the sensor 62 at the rear surface of the sensor surface 621.

As illustrated in FIG. 4 and FIG. 5, when the holder body 601 is viewed from the sensor 62, the snap fits 602, 603, 604, and 605 and the sensor surface 621 are disposed to overlap one on another in a straight line perpendicular to the longitudinal direction of the sensor 62. This structure allows the sensor surface 621 to reliably come into contact with the surface of the development housing 50.

Figure 6:
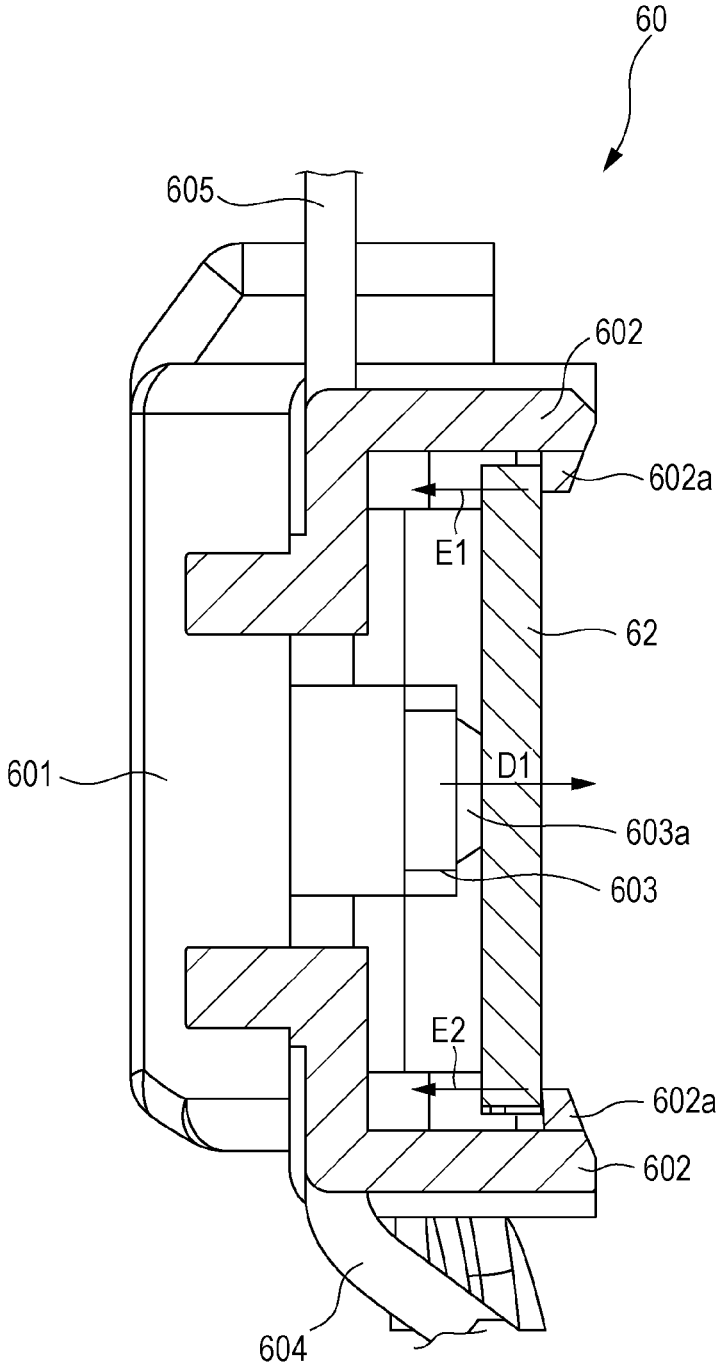
FIG. 6 is a cross-sectional view of a sensor holder according to an exemplary embodiment that is not being attached to a development housing.

FIG. 6 is a cross-sectional view of the sensor holder 60 illustrated in FIG. 4, taken along line VI-VI of FIG. 4. FIG. 6 illustrates the sensor holder 60 in the state of not being attached to the development housing 50.

In the state of FIG. 6, the protrusion 603*a* of the snap fit 603 presses the sensor 62 in the direction of arrow D1. The lugs 602*a* of the pair of snap fits 602 are in contact with the end portions of the sensors 62. The lugs 602*a* thus block movement of the sensor 62 pressed in the direction of arrow D1, and a force in the directions of arrow E1 and arrow E2, which are opposite to the direction of arrow D1, is exerted from the lugs 602*a* to the sensor 62. Thus, the sensor 62 is held on the holder body 601 with the two different snap fits 602 and 603.

Figure 7A:
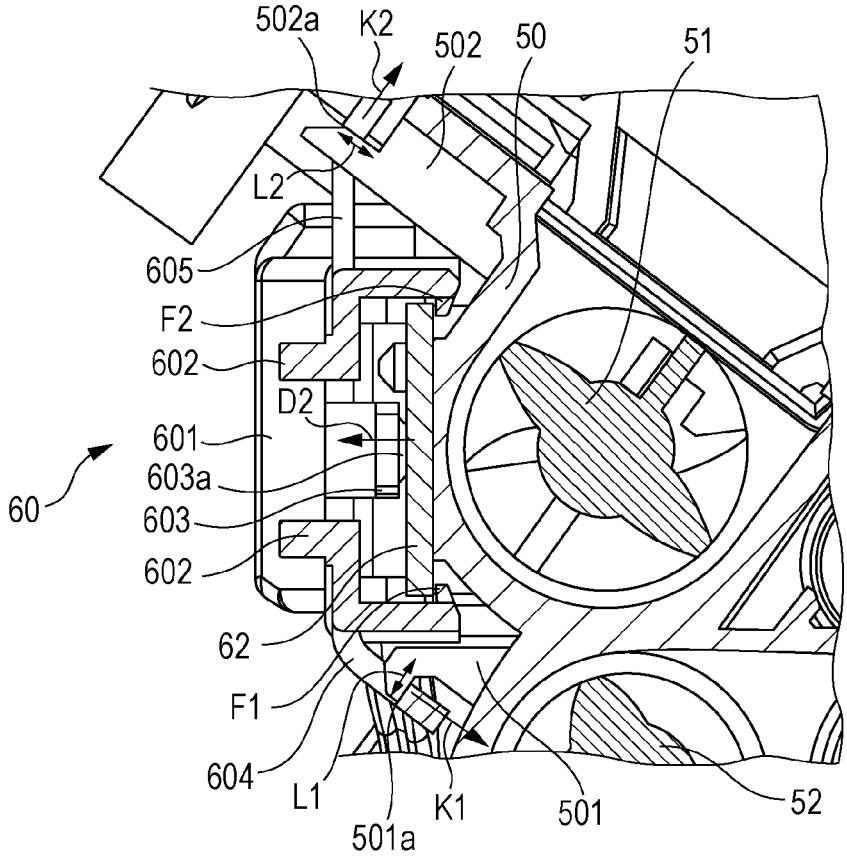
FIGS. 7A, 7B, and 7C are cross-sectional views of a sensor holder according to an exemplary embodiment that has been attached to the development housing.
Figure 7B:
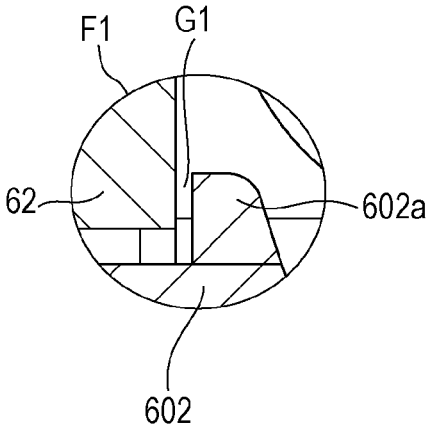
Figure 7C:
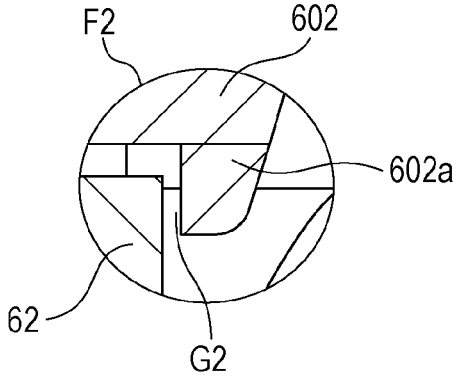

FIG. 7 illustrates the sensor holder 60 in the state of being attached to the development housing 50. FIG. 7A is a cross-sectional view of the sensor holder 60 illustrated in FIG. 4, taken along line VI-VI, in the state of being attached to the development housing 50. FIGS. 7B and 7C are enlarged views of portions F1 and F2, which are around the lugs 602*a* of the snap fits 602 in FIG. 7A.

In the state of FIG. 7A, the snap fits 604 and 605 are engaged with the protrusions 501 and 502 of the development housing 50, so that the holder body 601 is fixed to the development housing 50. The protrusion 501 includes a flat portion 501*a*. The snap fit 604 is engaged with the protrusion 501 as a result of being in contact with the flat portion 501*a*. The snap fit 604 receives a force in the direction of arrow K1. The protrusion 502 includes a lug 502*a*. The snap fit 605 is engaged with the protrusion 502 as a result of being in contact with the lug 502*a*. The snap fit 605 receives a force in the direction of arrow K2. Thus, forces are exerted on the snap fits 604 and 605 in the directions of arrows K1 and K2, so that the sensor 62 is in the state of being pressed against the surface of the development housing 50.

As illustrated in FIGS. 7A to 7C, in the state where the holder body 601 is fixed to the development housing 50, the sensor 62 is in contact with the surface of the development housing 50. Thus, a force is exerted on the sensor 62 from the surface of the development housing 50 in the direction of arrow D2 to press the sensor 62. Thus, unlike in the state of FIG. 6, the snap fit 603 that presses the sensor 62 from the rear surface of the sensor 62 deforms to allow the sensor 62 to move in the direction of arrow D2. The sensor 62 is held between the protrusion 603*a* of the snap fit 603 and the surface of the development housing 50.

In the state of FIG. 6, that is, in the state where the sensor holder 60 is not attached to the development housing 50, the sensor 62 is in contact with the lugs 602*a* of the snap fits 602. In the state of FIG. 7A, on the other hand, the sensor 62 is moved in the direction of arrow D2, and thus is no longer in contact with the lugs 602*a* of the snap fits 602. As illustrated in FIG. 7B and FIG. 7C, in which the portions near the snap fits 602 are enlarged, gaps G1 and G2 are left between the lugs 602*a* of the snap fits 602 and the sensor 62. The gaps G1 and G2 prevent the snap fits 602 from interfering with the sensor 62, so that the sensor 62 preferably comes into contact with the surface of the development housing 50.

Figure 8:
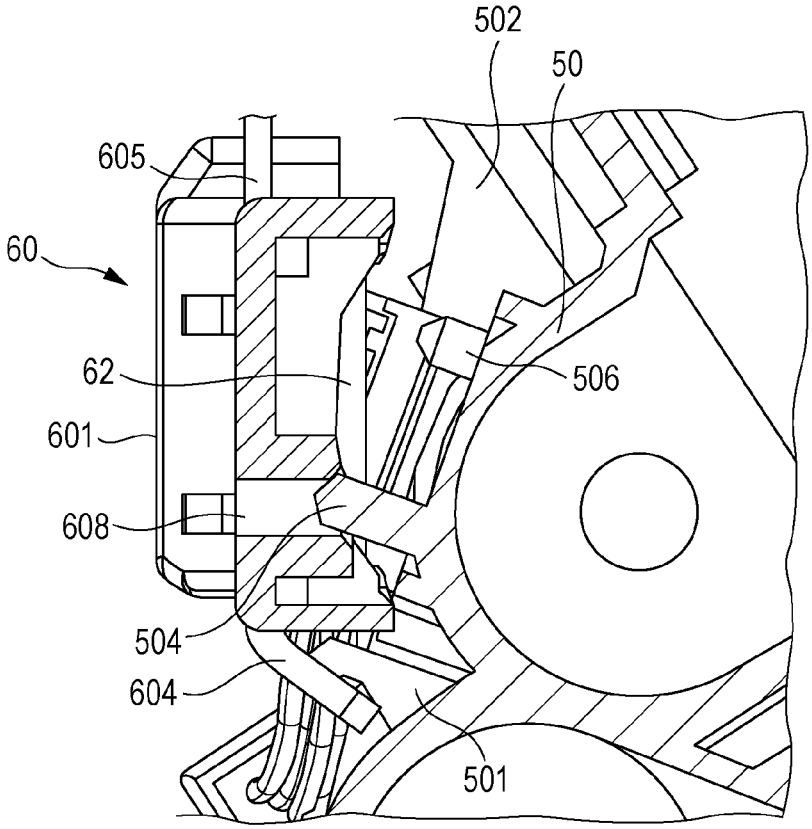
FIG. 8 is a cross-sectional view of a sensor holder according to an exemplary embodiment in the state of being attached to the development housing.

FIG. 8 illustrates the sensor holder 60 in the state of being attached to the development housing 50. FIG. 8 is a cross-sectional view taken by the plane perpendicular to the rotation axis of the development roller 53 at the position of the boss 504 of the development housing 50, and taken along line VIII-VIII in FIG. 4 in the state where the sensor holder 60 is being attached to the development housing 50.

FIG. 8 illustrates the state where an operator brings the sensor holder 60 toward an attachment surface of the development housing 50 while tilting the development housing 50 to have a portion of the development housing 50 closer to the protrusion 501, in order to hook the snap fit 604 of the holder body 601 on the protrusion 501 to engage the snap fit 604 on the protrusion 501. From this state, using the engaged portion at which the snap fit 604 and the protrusion 501 are engaged (the flat portion 501*a* in FIG. 7, described above) as a fulcrum, the operator brings the portion of the holder body 601 including the snap fit 605 toward the surface of the development housing 50. At this time, the position of the holder body 601 in the longitudinal direction is adjusted to allow the boss 503 of the development housing 50 to fit into the round hole 607 of the holder body 601 (FIG. 8 does not illustrate the round hole 607 and the boss 503).

After the snap fit 605 of the holder body 601 is brought toward the protrusion 502 of the development housing 50 and the boss 503 fits into the round hole 607, the boss 504 of the development housing 50 fits into the long hole 608 of the holder body 601, as illustrated in FIG. 8. The operator then brings the snap fit 605 of the holder body 601 toward the protrusion 502 of the development housing 50 to engage the snap fit 605 with the protrusion 502. Specifically, the snap fit 605 is engaged with the lug 502*a* of FIG. 7, described above. Thus, the sensor holder 60 is fixed to the development housing 50. In this manner, the sensor holder 60 is attached to the development housing 50 using the snap fits 604 and 605 while the position of the holder body 601 relative to the development housing 50 is fixed using the round hole 607 and the boss 503.

As to the length of the snap fits 604 and 605 in the vertical direction in FIG. 8 (dimension in the direction perpendicular to the longitudinal direction of the sensor 62), the snap fit 605 is longer than the snap fit 604. Specifically, the snap fit 604, serving as a fulcrum during attachment to the development housing 50, is shorter, and is thus easily attachable.

The boss 503 (refer to FIG. 3) and the boss 504 are disposed at positions closer to the protrusion 501 than to the protrusion 502. The boss 503, which fits into the round hole 607 of the holder body 601, is located closer to the protrusion 501, serving as a fulcrum during an attachment. Thus, the position of the holder body 601 relative to the development housing 50 during attachment is easily fixed.

In comparison between the length L1 of the flat portion 501*a* of the protrusion 501 and the length L2 of the lug 502*a* of the protrusion 502, which are illustrated in FIG. 7A, the length L1 of the flat portion 501*a* is longer. Thus, the snap fit 604 is easily engaged with the flat portion 501*a* of the protrusion 501, serving as a fulcrum, so that the attachment of the sensor holder 60 is facilitated. As illustrated in FIGS. 7A to 7C, in comparison between the positions, in the height direction, of the flat portion 501*a* of the protrusion 501 and the lug 502*a* of the protrusion 502 with respect to the surface of the development housing 50 with which the sensor 62 is in contact, the lug 502*a* of the protrusion 502 is located at a higher position. The position of the flat portion 501*a* of the protrusion 501, serving as a fulcrum, is lower, and thus, an attachment of the sensor holder 60 to the development housing 50 is facilitated.

Figure 9:
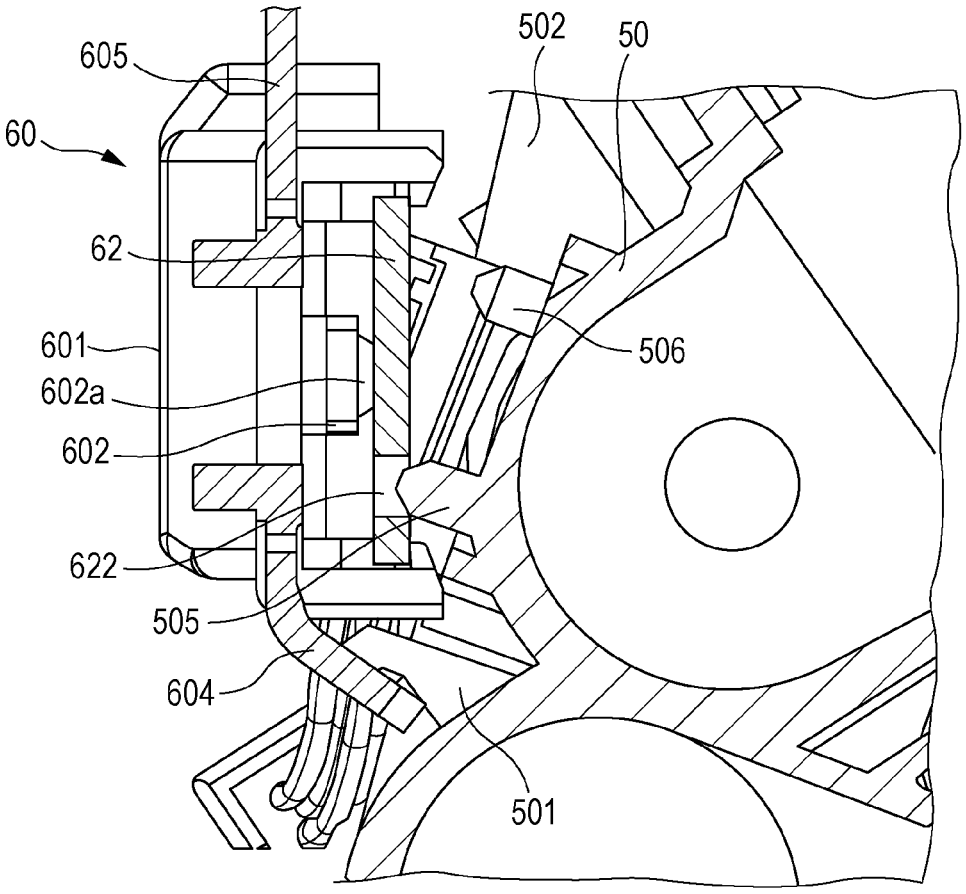
FIG. 9 is a cross-sectional view of a sensor holder according to an exemplary embodiment in the state of being attached to the development housing.

As in the case of FIG. 8, FIG. 9 illustrates the state where the sensor holder 60 is being attached to the development housing 50, and is a cross-sectional view of a portion different from the portion in FIG. 8. FIG. 9 is a cross-sectional view taken by the plane perpendicular to the rotation axis of the development roller 53 at a position of the boss 505 of the development housing 50, and taken along line IX-IX of the sensor holder 60 in FIG. 4, when the sensor holder 60 is being attached to the development housing 50. When, as illustrated in FIG. 8, the bosses 503 and 504 are respectively fitted into the round hole 607 and the long hole 608 of the holder body 601, the boss 505 of the development housing 50 is fitted into the round hole 622 of the sensor 62, as illustrated in FIG. 9.

As described above, the sensor 62 is movable in the longitudinal direction until it hits against the ribs 609. Thus, when the round hole 622 of the sensor 62 approaches the boss 505, the center position of the round hole 622 may be displaced from the center position of the boss 505. Here, the boss 505 has a conical tip end. Thus, when the peripheral portion of the round hole 622 hits against the conical portion of the boss 505, the sensor 62 moves so that the round hole 622 is guided toward the boss 505. Thereafter, when the operator further brings the snap fit 605 of the holder body 601 toward the protrusion 502 of the development housing 50, the boss 506 fits into the long hole 623 of the sensor 62 (FIG. 9 does not illustrate the long hole 623). Thereafter, the operator further brings the snap fit 605 of the holder body 601 toward the protrusion 502 of the development housing 50, and engages the snap fit 605 with the protrusion 502 to fix the sensor holder 60 to the development housing 50. In this manner, the sensor holder 60 is attached to the development housing 50 while the position of the sensor 62 on the holder body 601 relative to the development housing 50 is fixed.

As illustrated in FIGS. 8 and 9, as to the height of the bosses 503, 504, 505, and 506 with respect to the surface of the development housing 50 with which the sensor 62 is in contact, the bosses 503 and 504 are higher than the bosses 505 and 506. Although FIG. 8 does not illustrate the boss 503, the boss 503 has a height equivalent to the height of the boss 504. The height of the boss 503, which fits into the round hole 607 of the holder body 601, is higher than the height of the boss 505, which fits into the round hole 622 of the sensor 62. Thus, the position of the sensor 62 relative to the development housing 50 during attachment is accurately fixed. Specifically, in the state of FIG. 8, firstly, the higher boss 503 starts being fitted into the round hole 607 of the holder body 601 to fix the position of the holder body 601. Thereafter, in the state of FIG. 9, the boss 505 starts being fitted into the round hole 622 of the sensor 62 to fix the position of the sensor 62. After the position of the holder body 601 is fixed, the position of the sensor 62 is fixed. Thus, the position of each component is fixed, so that the position of the sensor 62 is accurately fixed. In the present exemplary embodiment, a low-cost sensor, such as a sensor including an exposed circuit board, may be used as the sensor 62. In addition, the sensor 62 may be installed without using additional components (with fewer components than in an existing structure), and thus costs low.

MODIFIED EXAMPLE

The above-described exemplary embodiments may be modified in various manners. Modification examples of the exemplary embodiments are described, below. The above-described embodiments and modification examples described below may be appropriately combined together.

(1) In the above-described exemplary embodiments, the snap fits 604 and 605 of the holder body 601 do not include lugs, and are engaged with the flat portion 501*a* of the protrusion 501 and the lug of the protrusion 502 of the development housing 50. This is not the only possible structure, however. The snap fits 604 and 605 of the holder body 601 may include lugs.

(2) In the above-described exemplary embodiments, a sensor detects the toner density. This is not the only possible structure, however. The sensor may detect another physical quantity as long as the sensor is, for example, a magnetic or optical contactless sensor disposed on a board.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sensor holder, comprising:

a holder body that accommodates a sensor;

a first snap fit that presses the sensor from a rear surface of the sensor;

two second snap fits that fix the holder body to a housing at at least two points; and a third snap fit that directly restricts movement of the sensor in a direction in which the second snap fits are arranged, while the sensor is accommodated in the holder body, wherein the first snap fit is disposed between the two second snap fits, wherein the sensor is in contact with the first snap fit and the third snap fit in a state where the sensor is accommodated in the holder body and the holder body is not fixed to the housing, wherein, when the second snap fits fix the holder body to the housing, the sensor is spaced apart from the third snap fit.

2. The sensor holder according to claim 1, wherein, when the holder body is viewed from the sensor, the first snap fit, the second snap fits, and the third snap fit are located to overlap with the sensor in a specific direction.

3. The sensor holder according to claim 2, wherein the first snap fit, the second snap fits, and the third snap fit are arranged in a straight line.

4. The sensor holder according to claim 1, wherein the sensor is long in a first direction, and wherein the holder body includes an elliptic first hole long in a longitudinal direction of the sensor, and a circular second hole located further from the second snap fits than the first hole.

5. The sensor holder according to claim 4, wherein the second hole is deeper than the first hole.

6. The sensor holder according to claim 1, wherein the sensor is long in a first direction, and wherein the first snap fit includes a support portion extending in a longitudinal direction of the sensor.

7. The sensor holder according to claim 1, further comprising:

a guide member that guides a wire harness extending from the sensor.

8. The sensor holder according to claim 7, wherein the guide member is located, in a direction perpendicular to a longitudinal direction of the sensor, closer to the first snap fit than an opposite surface of the sensor, the opposite surface being opposite to the rear surface of the sensor.

9. The sensor holder according to claim 1, further comprising:

a guide member that is disposed at one of ends of the holder body to guide a wire harness extending from the sensor, the end being further when viewed from the third snap fit than the other end.

10. The sensor holder according to claim 1, wherein the first snap fit has a curved tip end.

11. A sensor housing unit, comprising:

the sensor holder according to claim 1; and the housing including a first protrusion and a second protrusion, the first protrusion including a flat portion engaged with a first one of the second snap fits and forming a fulcrum used to attach a second one of the second snap fits, the second protrusion including a lug engaged with the second one of the second snap fits.

12. The sensor housing unit according to claim 11, wherein, when the sensor is viewed from a surface over which the sensor and the housing are in contact with each other, the second protrusion is located higher than the first protrusion with respect to the surface over which the sensor and the housing are in contact with each other.

13. The sensor housing unit according to claim 12, wherein the second one of the second snap fits is longer than the first one of the second snap fits.

14. The sensor housing unit according to claim 11, wherein the housing includes a first boss that fixes positions of the sensor holder and the housing, and wherein the first boss is located closer to the first protrusion than to the second protrusion.

15. The sensor housing unit according to claim 14, wherein the housing includes a second boss that fixes positions of the sensor and the housing, and wherein the first boss is higher than the second boss with respect to a surface over which the sensor and the housing are in contact with each other.

16. The sensor housing unit according to claim 11, wherein the flat portion is longer than the lug.

* * * * *